US010668483B2

(12) United States Patent
Krichtafovitch

(10) Patent No.: US 10,668,483 B2
(45) **Date of Patent: *Jun. 2, 2020**

(54) ELECTRONIC AIR CLEANERS AND ASSOCIATED SYSTEMS AND METHODS

(71) Applicant: University of Washington through its Center for Commercialization, Seattle, WA (US)

(72) Inventor: Igor Krichtafovitch, Kirkland, WA (US)

(73) Assignee: University of Washington, Seattle, WA (US)

( * ) Notice: Subject to any disclaimer, the term of this patent is extended or adjusted under 35 U.S.C. 154(b) by 392 days.

This patent is subject to a terminal disclaimer.

(21) Appl. No.: 15/287,644

(22) Filed: Oct. 6, 2016

(65) Prior Publication Data

US 2017/0021363 A1 Jan. 26, 2017

Related U.S. Application Data

(63) Continuation of application No. 14/401,082, filed as application No. PCT/US2013/041259 on May 15, 2013, now Pat. No. 9,488,382.

(Continued)

(51) Int. Cl.
*B03C 3/47* (2006.01)
*F24F 13/28* (2006.01)

(Continued)

(52) U.S. Cl.
CPC ..... *B03C 3/47* (2013.01); *B03C 3/08* (2013.01); *B03C 3/12* (2013.01); *B03C 3/155* (2013.01);

(Continued)

(58) Field of Classification Search
None
See application file for complete search history.

(56) References Cited

U.S. PATENT DOCUMENTS 3,887,809 A 6/1975 Marx et al.
3,891,846 A 6/1975 Ito (Continued)

FOREIGN PATENT DOCUMENTS

CN 2342893 Y 10/1999
CN 101862704 A 10/2010

(Continued)

OTHER PUBLICATIONS

Xueliang Feng, "Fabrication and characterization of antistatic epoxy composite with multi-walled carbon nanotube-functionalized melamine foam", Apr. 2018, https://web.archive.org/web/20190122181344/https://www.researchgate.net/figure/Surface-resistivity-of-melamine-foam-pristine-MWCNTs-a-and-melamine-foam-MA-APA.*

(Continued)

*Primary Examiner* — Amber R Orlando
*Assistant Examiner* — Brit E. Anbacht
(74) *Attorney, Agent, or Firm* — Perkins Coie LLP

(57) ABSTRACT

Electronic air cleaners for use in heating, air-conditioning, and ventilation (HVAC) systems and associated methods and systems are disclosed herein. In one embodiment, an electronic air cleaner includes one or more collecting electrodes having a collection material with a porous, open-cell structure and a conductive internal portion. The collection material can be configured to collect and receive charged particulate matter in an airflow path. After a period of time, used collection material can be removed from individual collecting electrodes and replaced with new collection material.

20 Claims, 10 Drawing Sheets

Related U.S. Application Data

(60) Provisional application No. 61/647,045, filed on May 15, 2012.

(51) Int. Cl.

| | |
|---|---|
| ***B03C 3/45*** | (2006.01) |
| ***B03C 3/60*** | (2006.01) |
| ***B03C 3/68*** | (2006.01) |
| ***B03C 3/74*** | (2006.01) |
| ***B03C 3/08*** | (2006.01) |
| ***B03C 3/12*** | (2006.01) |
| ***B03C 3/155*** | (2006.01) |
| ***B03C 3/36*** | (2006.01) |
| ***B03C 3/62*** | (2006.01) |
| ***B03C 3/64*** | (2006.01) |
| ***B03C 3/72*** | (2006.01) |
| ***F24F 3/16*** | (2006.01) |

(52) U.S. Cl.

CPC ..... *B03C 3/366* (2013.01); *B03C 3/45* (2013.01); *B03C 3/60* (2013.01); *B03C 3/62* (2013.01); *B03C 3/64* (2013.01); *B03C 3/68* (2013.01); *B03C 3/72* (2013.01); *B03C 3/74* (2013.01); *B03C 3/743* (2013.01); *F24F 3/1603* (2013.01); *F24F 13/28* (2013.01); *F24F 2003/1635* (2013.01)

(56) References Cited

U.S. PATENT DOCUMENTS

| | | | | |
|---|---|---|---|---|
| 3,965,400 | A | 6/1976 | Tolliver | |
| 3,978,379 | A | 8/1976 | DelVecchio et al. | |
| 3,985,524 | A | 10/1976 | Masuda et al. | |
| 4,408,865 | A | 10/1983 | Camis et al. | |
| 4,689,056 | A | 8/1987 | Noguchi et al. | |
| 5,055,115 | A | 10/1991 | Yikai et al. | |
| 5,055,118 | A * | 10/1991 | Nagoshi | B03C 3/08 96/77 |
| 5,522,909 | A | 6/1996 | Haggard et al. | |
| 5,582,632 | A | 12/1996 | Nohr et al. | |
| 5,698,165 | A | 12/1997 | Terada et al. | |
| 6,176,977 | B1 | 1/2001 | Taylor et al. | |
| 6,231,643 | B1 | 5/2001 | Pasic et al. | |
| 6,251,171 | B1 | 6/2001 | Marra et al. | |
| 6,773,489 | B2 | 8/2004 | Dunn et al. | |
| 6,783,575 | B2 | 8/2004 | Pasic et al. | |
| 6,855,190 | B1 | 2/2005 | Nikkhah et al. | |
| 6,888,314 | B2 | 5/2005 | Krichtafovitch et al. | |
| 6,932,857 | B1 * | 8/2005 | Krigmont | B03C 3/08 55/341.1 |
| 6,937,455 | B2 | 8/2005 | Krichtafovitch et al. | |
| 6,955,708 | B1 * | 10/2005 | Julos | B03C 3/011 422/121 |
| 7,105,041 | B2 | 9/2006 | Dunn et al. | |
| 7,150,780 | B2 | 12/2006 | Krichtafovitch et al. | |
| 7,248,003 | B2 | 7/2007 | Krichtafovitch et al. | |
| 7,258,729 | B1 | 8/2007 | Barsimanto et al. | |
| 7,594,958 | B2 | 9/2009 | Krichtafovitch et al. | |
| 8,080,094 | B2 | 12/2011 | Vanderginst et al. | |
| 9,827,573 | B2 * | 11/2017 | Afanasiev | B03C 3/60 |
| 2003/0217642 | A1 | 11/2003 | Pasic et al. | |
| 2003/0217643 | A1 | 11/2003 | Masek et al. | |
| 2005/0051028 | A1 * | 3/2005 | Botvinnik | B03C 3/08 96/88 |
| 2006/0107834 | A1 | 5/2006 | Vandenbelt et al. | |
| 2006/0268490 | A1 | 11/2006 | Joannou | |
| 2007/0256563 | A1 | 11/2007 | Volodina et al. | |
| 2008/0047434 | A1 * | 2/2008 | Kobayashi | B03C 3/08 96/95 |
| 2009/0053113 | A1 | 2/2009 | Mai | |
| 2010/0144913 | A1 * | 6/2010 | Alteheld | A01N 25/16 521/88 |
| 2011/0038771 | A1 | 2/2011 | Buelow et al. | |
| 2014/0041370 | A1 * | 2/2014 | Solbrig | F01N 3/206 60/295 |
| 2015/0224738 | A1 | 8/2015 | Gallagher | |
| 2015/0266033 | A1 * | 9/2015 | Shao | B03C 3/64 96/99 |
| 2015/0323217 | A1 * | 11/2015 | Krichtafovitch | B03C 3/08 95/74 |
| 2016/0074876 | A1 * | 3/2016 | Afanasiev | B03C 3/60 96/98 |
| 2016/0074877 | A1 * | 3/2016 | Afanasiev | B03C 3/08 96/75 |
| 2017/0354977 | A1 * | 12/2017 | Krichtafovitch | B03C 3/08 |
| 2017/0354980 | A1 * | 12/2017 | Krichtafovitch | B03C 3/60 |
| 2017/0354981 | A1 * | 12/2017 | Krichtafovitch | B03C 3/41 |
| 2018/0015481 | A1 * | 1/2018 | Rothenberg | B03C 3/12 |

FOREIGN PATENT DOCUMENTS

| | | | | |
|---|---|---|---|---|
| CN | 102000632 | A | 4/2011 | |
| DE | 2854742 | A1 * | 7/1980 | B03C 3/12 |
| DE | 2854742 | A1 | 7/1980 | |
| DE | 8810485 | U1 | 1/1989 | |
| DE | 19859827 | A1 | 6/2000 | |
| GB | 1559629 | A | 1/1980 | |
| JP | S5310484 | U | 1/1978 | |
| JP | S5310484 | B2 | 4/1978 | |
| JP | 54170328 | U | 12/1979 | |
| JP | S5687143 | A | 7/1981 | |
| JP | 58044245 | U | 3/1983 | |
| JP | S59171019 | A | 9/1984 | |
| JP | 61218644 | A | 9/1986 | |
| JP | 2000005633 | A | 1/2000 | |
| JP | 2002143719 | A | 5/2002 | |
| JP | 2008539064 | A | 11/2008 | |
| JP | 2008539067 | A | 11/2008 | |
| JP | 2011016056 | A | 1/2011 | |

OTHER PUBLICATIONS

DE 2854742 A1 Machine Translation, translated 2016.*

Office Action dated Apr. 25, 2017 in Japan Application No. 2015-512816, 17 pages.

Examination Report dated Jun. 22, 2018 in European Patent Application No. 13727711.7, 8 pages.

B. Komeili et al., "Flow characteristics of wire-rod type electrohydrodynamic gas pump under negative corona operations," Journal of Electrostatics, May 2008, vol. 66, No. 5-6, pp. 342-353.

I. Krichtafovitch et al. , "Design of an Electronic Air Cleaner with Porous Collecting Electrodes," Proceedings of the 2013 Electrostatics Society of America (ESA) Annual Meeting on Electrostatics, Jun. 2013, 8 pages.

International Search Report and Written Opinion dated Sep. 5, 2013 in International Application No. PCT/US2013/041259 filed May 15, 2013.

K. Adamiak and P. Atten, "Simulation of corona discharge in point—plane configuration " Journal of Electrostatics, Jun. 2004, vol. 61, No. 2, pp. 85-98.

M. Quast and N. R. Lalic, "Measuring and Calculation of Positive Corona Currents Using Comsol Multiphysics " Proceedings of the COMSOL Conference, Mar. 2009, 7 pages.

Office Action dated Mar. 10, 2016 in China Application No. 201380037669.1, 41 pages.

Examination Report dated Jan. 20, 2017 in Australian Application No. 2013262819, 4 pages.

Office Action dated Oct. 4, 2016 in Japan Application No. 2015-512816, 17 pages.

First Examination Report dated Dec. 21, 2018 in Australian Patent Application No. 2017201354, 4 pages.

Office Action dated Feb. 28, 2019 in Canadian Patent Application No. 2,873,601, 5 pages.

* cited by examiner

ELECTRONIC AIR CLEANERS AND ASSOCIATED SYSTEMS AND METHODS

CROSS-REFERENCE TO RELATED APPLICATION(S)

This application is a continuation of U.S. application Ser. No. 14/401,082, filed Nov. 13, 2014, which is a 371 of International Application No. PCT/US2013/041259, filed May 15, 2013, which claims the benefit of pending U.S. Provisional Application No. 61/647,045, filed May 15, 2012. The foregoing applications are incorporated herein by reference in their entireties.

TECHNICAL FIELD

The present technology relates generally to cleaning gas flows using electrostatic filters and associated systems and methods. In particular, several embodiments are directed toward electronic air cleaners for use in heating, air-conditioning, and ventilation (HVAC) systems having collection electrodes lined with a collection material having an open-cell structure, although these or similar embodiments may also be used in cleaning systems for other types of gases, in industrial electrostatic precipitators, and/or in other forms of electrostatic filtration.

BACKGROUND

The most common types of residential or commercial HVAC air filters employ a fibrous filter media (made from polyester fibers, glass fibers or microfibers, etc.) placed substantially perpendicular to the airflow through which air may pass (e.g., an air conditioner filter, a HEPA filter, etc.) such that particles are removed from the air mechanically (coming into contact with one or more fibers and either adhering to or being blocked by the fibers); some of these filters are also electrostatically charged (either passively during use, or actively during manufacture) to increase the chances of particles coming into contact and staying adhered to the fibers.

Another form of air filter is known as an electronic air cleaner (EAC). A conventional EAC includes one or more corona electrodes and one or more smooth metal collecting electrode plates that are substantially parallel to the airflow. The corona electrodes produce a corona discharge that ionizes air molecules in an airflow received into the filter. The ionized air molecules impart a net charge to nearby particles (e.g., dust, dirt, contaminants etc.) in the airflow. The charged particles are subsequently electrostatically attracted to one of the collecting electrode plates and thereby removed from the airflow as the air moves past the collecting electrode plates. After a sufficient amount of air passes through the filter, the collecting electrodes can accumulate a layer of particles and dust and eventually need to be cleaned. Cleaning intervals may vary from, for example, thirty minutes to several days. Further, since the particles are on an outer surface of the collecting electrodes, they may become re-entrained in the airflow since a force of the airflow may exceed the electric force attracting the charged particles to the collecting electrodes, especially if many particles agglomerate through attraction to each other, thereby reducing the net attraction to the collector plate. Such agglomeration and re-entrainment may require use of a media afterfilter placed downstream and substantially perpendicular to the airflow, thereby increasing airflow resistance. Another limitation of conventional EACs is that corona wires can become contaminated by oxidation or other deposits during operation, thereby lowering their effectiveness and necessitating frequent cleaning. Moreover, the corona discharge can produce a significant amount of contaminants such as, for example, ozone, which may necessitate an implementation of activated carbon filters placed substantially perpendicular to the airflow that can increase airflow resistance.

While fibrous media filters do not produce ozone, they typically have to be cleaned and/or replaced regularly due to an accumulation of particles. Furthermore, fibrous media filters are placed substantially perpendicular to the airflow, increasing airflow resistance and causing a significant static pressure differential across the filter, which increases as more particles accumulate or collect in the filter. Pressure drop across various components of an HVAC system is a constant concern for designers and operators of mechanical air systems, since it either slows the airflow or increases the amount of energy required to move the air through the system. Accordingly, there exists a need for an air filter capable of relatively long intervals between cleaning and/or replacement and a relatively low pressure drop across the filter after installation in an HVAC system.

DETAILED DESCRIPTION

Figure 1A:
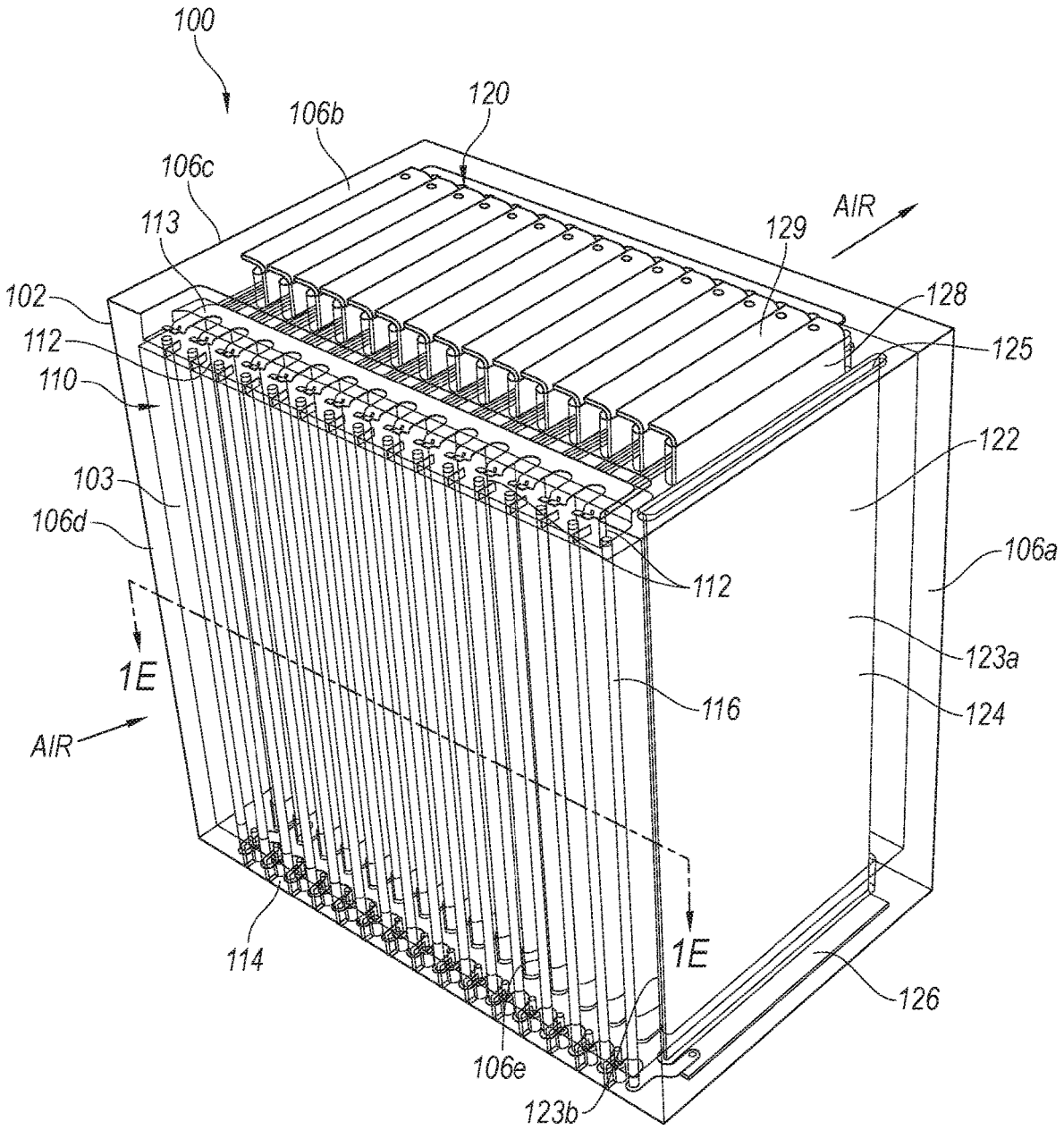
FIG. 1A is a rear isometric view of an EAC configured in accordance with embodiments of the present technology.

The present technology relates generally to cleaning gas flows using electrostatic filters and associated systems and methods. In one aspect of the present technology, an electronic air cleaner (EAC) may include a housing having an inlet, an outlet, and a cavity therebetween. An electrode assembly positioned in the air filter between the inlet and the outlet can include a plurality of first electrodes (e.g., collecting electrodes) and a plurality of second electrodes (e.g., repelling electrodes), both configured substantially parallel to the airflow. The first electrodes can include a first collecting portion made of a material having a porous, electrically conductive, open-cell structure (e.g., melamine foam). In some embodiments, the first and second electrodes may be arranged in alternating columns within the electrode assembly. The first electrodes can be configured to operate at a first electrical potential and the second electrodes can be configured to operate at a second electrical potential different from the first electrical potential. Moreover, in some embodiments, the EAC may also include a corona electrode disposed in the cavity at least proximate the inlet.

In another aspect of the present technology, a method of filtering air may include creating an electric field using a plurality of corona electrodes arranged in an airflow path, such that the corona electrodes are positioned to ionize at least a portion of air molecules from the airflow. The method may also include applying a first electric potential at a plurality of first electrodes spaced apart from the corona electrodes, and receiving, at the first collection portion, particulate matter electrically coupled to the ionized air molecules. In this aspect, each of the first electrodes may include a corresponding first collection portion comprising an open-cell, electrically conductive, porous media.

In yet another aspect of the present technology, an EAC having a housing with an inlet, an outlet and a cavity may include an ionizing stage and a collecting stage disposed in the cavity. The ionizing stage may be configured, for example, to ionize molecules in air entering the cavity through the inlet and charge particulates in the air. The collecting stage may include, for example, one or more collecting electrodes with an outer surface generally parallel with an airflow through the cavity and a first collecting portion made of a first material having an open-cell structure. In some embodiments, for example, the EAC may also include repelling electrodes in the collecting stage. In other embodiments, for example, the first material may comprise an open-cell, porous media, such as, for example, melamine foam. In some other embodiments, the first material may also comprise a disinfecting material and/or a pollution-reducing material.

Certain specific details are set forth in the following description and in FIGS. 1A-4B to provide a thorough understanding of various embodiments of the technology. Other details describing well-known structures and systems often associated with electronic air cleaners and associated devices have not been set forth in the following technology to avoid unnecessarily obscuring the description of the various embodiments of the technology. A person of ordinary skill in the art, therefore, will accordingly understand that the technology may have other embodiments with additional elements, or the technology may have other embodiments without several of the features shown and described below with reference to FIGS. 1A-4B.

Figure 1B:
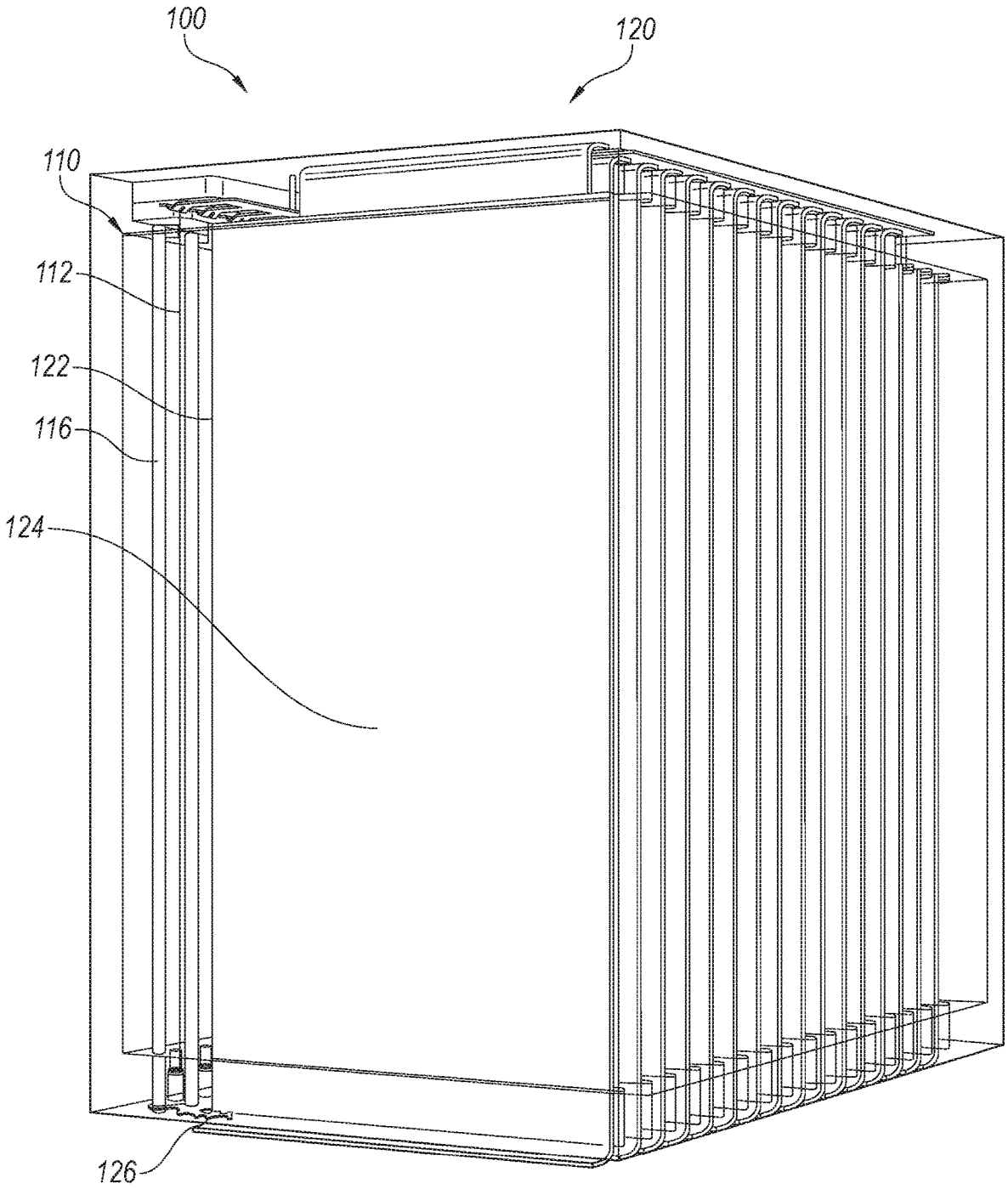
FIGS. 1B, 1C and 1D are side isometric, front isometric and underside views, respectively, of the EAC of FIG. 1A.
Figure 1C:
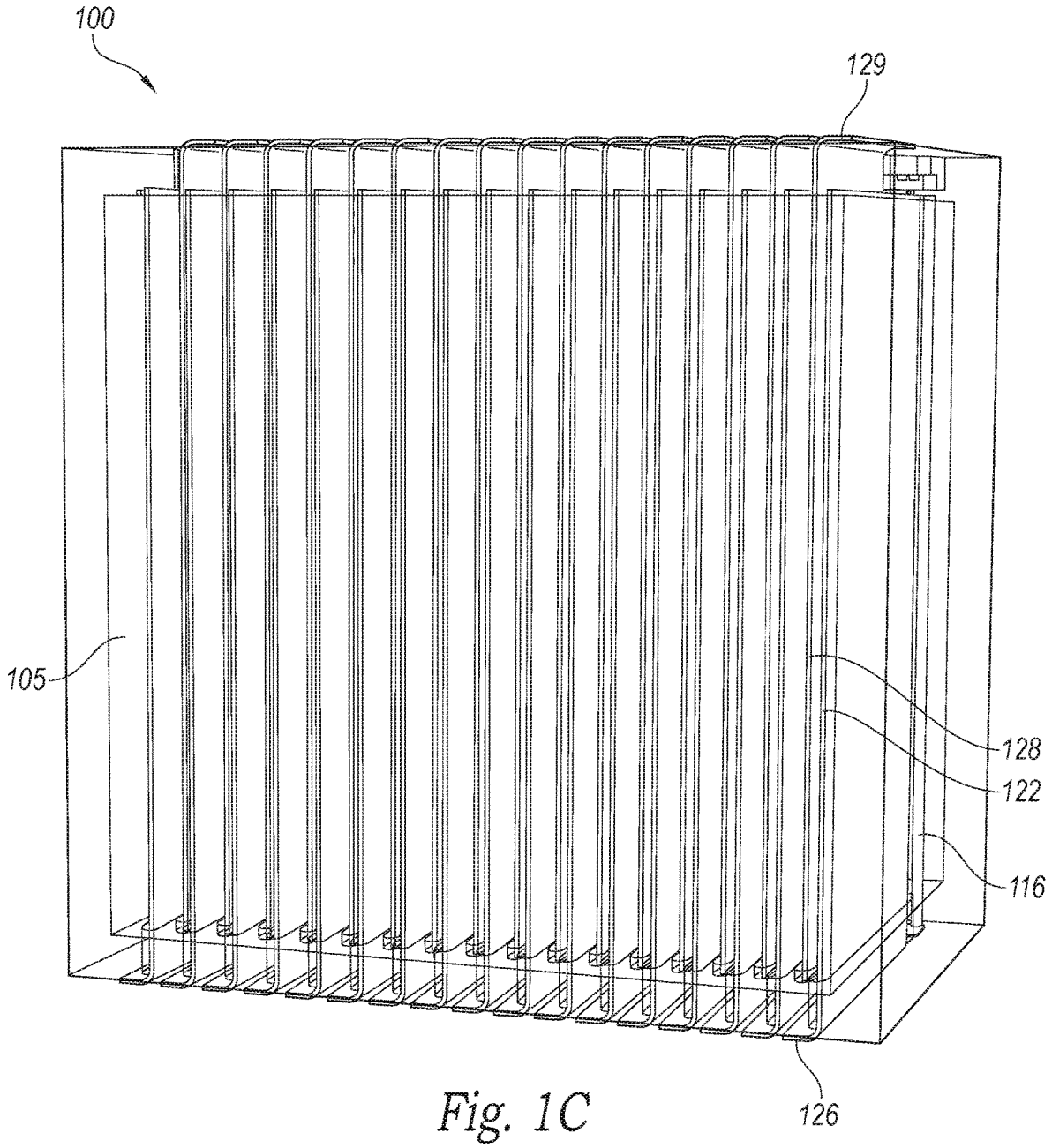
Figure 1D:
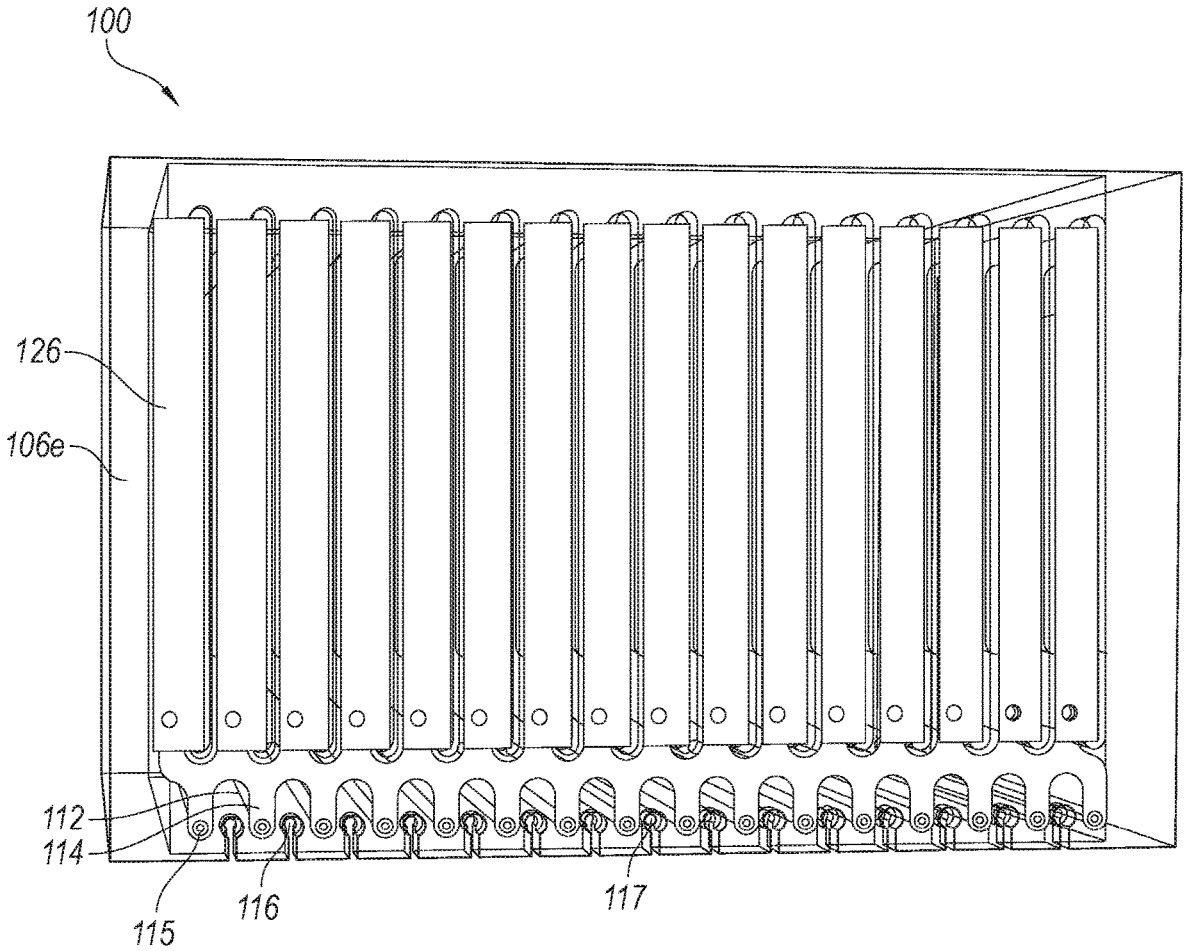
Figure 1E:
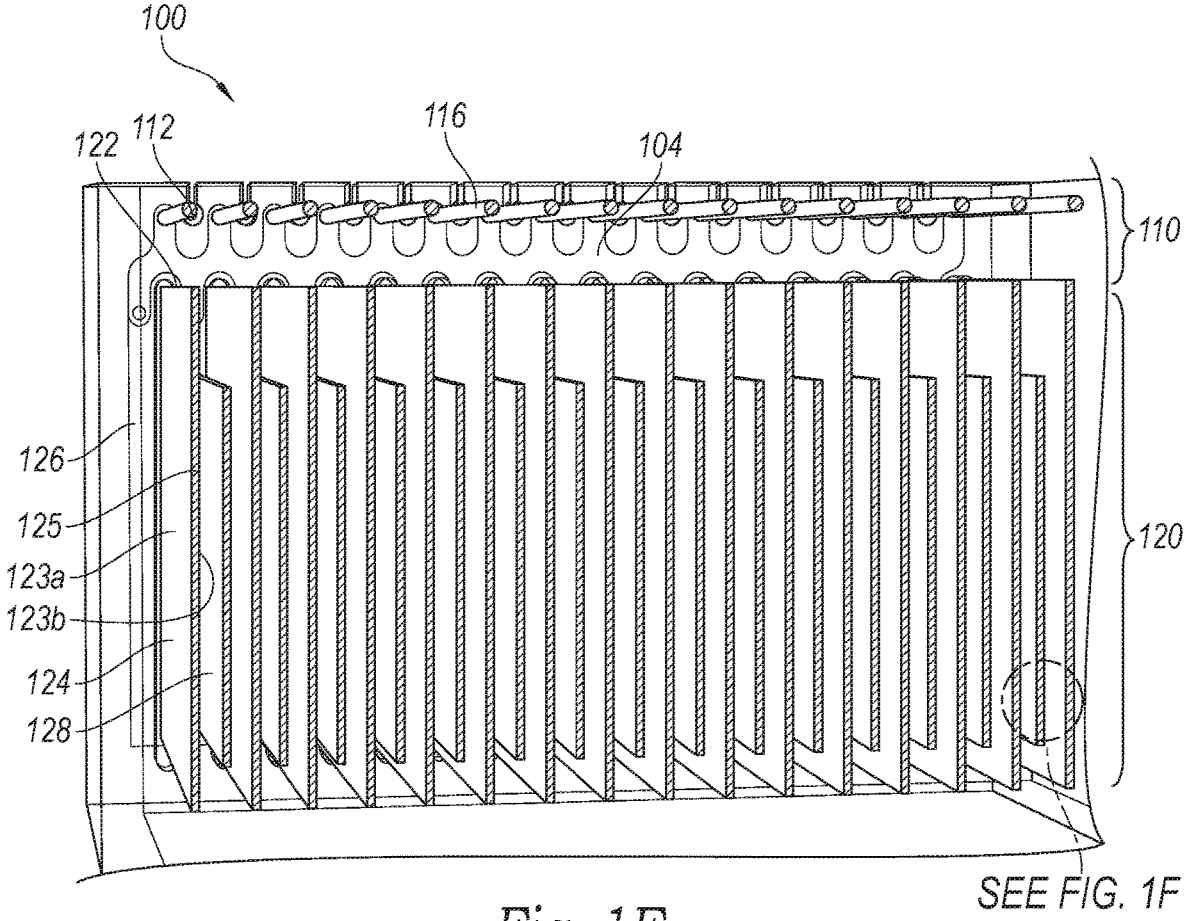
FIG. 1E is a top cross sectional view of FIG. 1A along a line 1E.
Figure 1F:
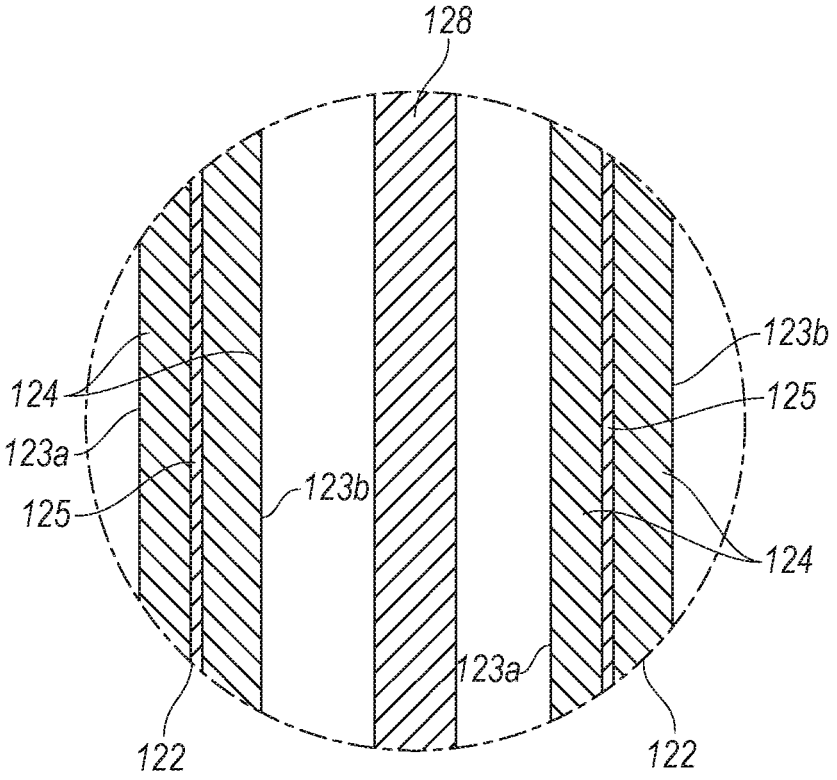
FIG. 1F is an enlarged view of a portion of FIG. 1E.

FIG. 1A is a rear isometric view of an electronic air cleaner 100. FIGS. 1B, 1C and 1D are front side isometric, front isometric and underside views, respectively, of the air cleaner 100. FIG. 1E is a top cross sectional view of the air cleaner 100 along the line 1E shown in FIG. 1A. FIG. 1F is an enlarged view of a portion of FIG. 1E. Referring to FIGS. 1A through 1F together, the air cleaner 100 includes a corona electrode assembly or ionizing stage 110 and a collection electrode assembly or collecting stage 120 disposed in a housing 102. The housing 102 includes an inlet 103, an outlet 105 and a cavity 104 between the inlet and the outlet. The housing 102 includes a first side surface 106*a*, an upper surface 106*b*, a second side surface 106*c*, a rear surface portion 106*d*, an underside surface 106*e*, and a front surface portion 106*f* (FIG. 1C). Portions of the surfaces 106*a-f* are hidden for clarity in FIGS. 1A through 1F. In the illustrated embodiment, the housing 102 has a generally rectangular solid shape. In other embodiments, however, the housing 102 can be built or otherwise formed into any suitable shape (e.g., a cube, a hexagonal prism, a cylinder, etc.).

The ionizing stage 110 is disposed within the housing 102 at least proximate the inlet 103 and comprises a plurality of corona electrodes 112 (e.g., electrically conductive wires, rods, plates, etc.). The corona electrodes 112 are arranged within the ionizing stage between a first terminal 113 and a second terminal 114. A plurality of individual apertures or slots 115 can receive and electrically couple the individual corona electrodes 112 to the second terminal 114. A plurality of exciting electrodes 116 are positioned between the corona electrodes 112 and the inlet 103. The first terminal 113 and the second terminal 114 can be electrically connected to a power source (e.g., a high voltage electrical power source) to produce an electrical field having a relatively high electrical potential difference (e.g., 5 kV, 10 kV, 20 kV, etc.) between the corona electrodes 112 and the exciting electrodes 116. In one embodiment, for example, the corona electrodes 112 can be configured to operate at +5 kV while the exciting electrodes 116 can be configured operate at ground. In other embodiments, however, both the corona electrodes 112 and the exciting electrodes 116 can be configured to operate at any number of suitable electrical potentials. Moreover, while the ionizing stage 110 in the illustrated embodiment includes the corona electrodes 112, in other embodiments the ionizing stage 110 may include any suitable means of ionizing molecules (e.g., a laser, an electrospray ionizer, a thermospray ionizer, a sonic spray ionizer, a chemical ionizer, a quantum ionizer, etc.). Furthermore, in the illustrated embodiment of FIGS. 1A-1F, the exciting electrodes 116 have a first diameter greater than (e.g., approximately twenty times larger) a second diameter of the corona electrodes 112. In other embodiments, however, the first diameter and second diameter can be any suitable size.

The collecting stage 120 is disposed in the cavity between the ionizing stage 110 and the outlet 105. The collecting stage 120 includes a plurality of collecting electrodes 122 and a plurality of repelling electrodes 128. In the illustrated embodiments of FIGS. 1A-1F, the collecting electrodes 122 and the repelling electrodes 128 are arranged in alternating rows within the collecting stage 120. In other embodiments, however, the collecting electrodes 122 and the repelling electrodes 128 may be positioned within the collecting stage 120 in any suitable arrangement.

Each of the collecting electrodes 122 includes a first collecting portion 124 having a first outer surface 123*a* opposing a second outer surface 123*b*, and an internal conductive portion 125 disposed therebetween. At least one of the first outer surface 123*a* and the second outer surface 123*b* may be arranged to be generally parallel with a flow of a gas (e.g., air) entering the cavity 104 via the inlet 103. The first collecting portion 124 can be configured to receive and collect and receive particulate matter (e.g., particles having a first dimension between 0.1 microns and 1 mm, between 0.3 microns and 10 microns, between 0.3 microns and 25 microns and/or between 100 microns and 1 mm), and may comprise, for example, an open-cell porous material or medium such as, for example, a melamine foam (e.g., formaldehyde-melamine-sodium bisulfite copolymer), a melamine resin, activated carbon, a reticulated foam, a nanoporous material, a thermoset polymer, a polyurethanes, a polyethylene, etc. The use of an open-cell porous material can lead to a substantial increase (e.g., a tenfold increase, a thousandfold increase, etc.) in the effective surface area of the collecting electrodes 122 compared to, for example, a smooth metal electrode that may be found in conventional electronic air cleaners. Moreover, the open-cell porous material can receive and collect particulate matter (dust, dirt, contaminants, etc.) within the material, thereby reducing accumulation of particulate matter on the outer surfaces 123*a* and 123*b*, as well as limiting the maximum size of agglomerates that may form from the collected particulates based on the size of a first dimension of the cells in the porous material (e.g., from about 1 micron to about 1000 microns, from about 200 microns to about 500 microns, from about 140 microns to about 180 microns, etc.) In some embodiments, the open-cell porous material can be made of a non-flammable material to reduce the risk of fire from, for example, a spark (e.g., a corona discharge from one of the corona electrodes 112). In some embodiments, the open-cell porous material may also be made from a material having a high-resistivity (e.g., greater than or equal to $1\times10^7$ Ω-m, $1\times10^9$ Ω-m, $1\times10^{11}$ Ω-m, etc.) Using a high resistivity material (e.g., greater than $10^2$ Ohm-m, between $10^2$ and $10^9$ Ohm-m, etc.) in the first collecting portion 124 can reduce, for example, a likelihood of a corona discharge between the corona electrodes and the collecting electrodes 122 or a spark over between the collecting electrode 122 and the repelling electrode 128. In some embodiments, the first collecting portion 124 may also include a disinfecting material (e.g., $TiO_2$) and/or a material (e.g., $MnO_2$, a thermal oxidizer, a catalytic oxidizer, etc.) selected to reduce and/or neutralize volatile organic compounds (e.g., ozone, formaldehyde, paint fumes, CFCs, benzene, methylene chloride, etc.). In other embodiments, the first collecting portion 124 may include one or more nanoporous membranes and/or materials (e.g., manganese oxide, nanoporous gold, nanoporous silver, nanotubes, nanoporous silicon, nanoporous polycarbonate, zeolites, silica aerogels, activated carbon, graphene, etc.) having pore sizes ranging from, for example, 0.1 nm-1000 nm. In some further embodiments, the first collecting portion 124 (comprising, e.g., one or more of the nanoporous materials above) may be configured to detect a composition of the particulate matter accumulated within the collecting electrodes 122. In these embodiments, a voltage can be applied across the first collecting portion 124 and various types of particulate matter may be detected by monitoring, for example, changes in an ionic current passing therethrough. If a particle of interest (e.g., a toxin, a harmful pathogen, etc.) is detected, then an operator of a facility control system (not shown) coupled to the air cleaner 100 can be alerted.

In some embodiments, the first collecting portion 124 may be made of a substantially rigid material. In certain of these embodiments, elastic or other tension-based mounting members are not necessary for securing the first collection portion 1224 within the cavity. For example, the rigidity of the material in these embodiments may be sufficient to substantially support itself in a vertical direction within the cavity. In certain of these embodiments, an internal conductive portion 125 is not included in the collecting electrodes 122, wherein material itself is sufficiently conductive to carry the requisite charge. In such embodiments, the material may include one or more of the conductive materials or compositions listed above.

Referring to FIG. 1F, the internal conductive portion 125 can include a conductive surface or plate (e.g., a metal plate) sandwiched between opposing layers of the first collecting portion 124 and adhered thereto via an adhesive (e.g., cyanoacrylate, an epoxy, and/or another suitable bonding agent). In other embodiments, however, the internal conductive portion 125 can comprise any suitable conductive material or structure such as, for example, a metal plate, a metal grid, a conductive film (e.g., a metalized Mylar film), a conductive epoxy, conductive ink, and/or a plurality of conductive particles (e.g., a carbon powder, nanoparticles, etc.) distributed throughout the collecting electrodes 122. A coupling structure or terminal 126 can couple the internal conductive portion 125 of each of the collecting electrodes 122 to an electrical power source (not shown). Similarly, a coupling structure or terminal 129 can couple each of the repelling electrodes 128 to an electrical power source (not shown). The collecting electrodes 122 may be configured to operate, for example, at a first electrical potential different from a second electrical potential of the repelling electrodes 128 when connected to the electrical power source. Furthermore, within individual collecting electrodes 122, the internal conductive portion 125 can be configured operate at a greater electrical potential than either the first outer surface 123*a* or the second outer surface 123*b* of the individual collecting electrodes. In some embodiments, for example, the internal conductive portion 125 may be configured to have a first electrical conductivity greater than a second electrical conductivity of first collecting portion 124. Accordingly, the first outer surface 123*a* and/or the second outer surface 123*b* may have a first electrical potential less than a second electrical potential at the internal conductive portion 125. A difference between the first and second electrical potentials, for example, can attract charged particles into the first collecting portion 124 toward the internal conductive portion 125. In some embodiments, for example, the outer surfaces 123*a* and 123*b* have a second electrical conductivity lower than the first electrical conductivity.

In operation, the air cleaner 100 can receive electric power from a power source (not shown) coupled to the corona electrodes 112, the exciting electrodes 116, the collecting electrodes 122, and the repelling electrodes 128. The individual corona electrodes 112 can receive, for example, a high voltage (e.g., 10 kV, 20 kV, etc.) and emit ions resulting in an electric current proximate the individual corona electrodes 112 and flowing toward the exciting electrodes 116 or/and the collecting electrodes 122. The corona discharges can ionize gas molecules (e.g., air molecules) in the incoming gas (e.g., air) entering the housing 102 and the cavity 104 through the inlet 103. As the ionized gas molecules collide with and charge incoming particulate matter that flows from the ionizing stage 110 toward the collecting stage 120, particulate matter (e.g., dust, ash, pathogens, spores, etc.) in the gas can be electrically attracted to and, thus, electrically coupled to the collecting electrodes 122. The repelling electrodes 128 can repel or otherwise direct the charged particulate matter toward adjacent collecting electrodes 122 due to a difference in electrical potential and/or a difference in electrical charge between the repelling electrodes 128 and the collecting electrodes 122. As described in further detail below with reference to FIGS. 2B and 2C, the repelling electrodes 128 may also include a means for aerodynamically directing charged particulate matter toward adjacent collecting electrodes 122.

The corona electrodes 112, the collecting electrodes 122, and the repelling electrodes 128 can be configured to operate at any suitable electrical potential or voltage relative to each other. In some embodiments, for example, the corona electrodes 112, the collecting electrodes 122, and the repelling electrodes 128 can all have a first electrical charge, but may also be configured to have first, second, third, and fourth voltages, respectively. A difference between the first, second, third and fourth voltage can determine a path that one or more charged particles (e.g., charged particulate matter) through the ionizing stage 110. For instance, the collecting electrodes 122 and the exciting electrodes 116 may be grounded, while the corona electrodes may have an electrical potential between, for example, 4 kV and 10 kV and the repelling electrodes 128 may have an electrical potential between, for example, 6 kV and 20 kV. Moreover, portions of the collecting electrodes 122 may have different electrical potentials relative to other portions. For example, in one or more individual collecting electrodes 122, the internal conductive portion 125 may have a different electrical potential (e.g., a higher electrical potential) than the corresponding first outer surface 123*a* or second outer surface 123*b*, thereby creating an electric field within the collecting portion 124.

As those of ordinary skill in the art will appreciate, the electrical potential difference between the internal conductive portion 125 and the corresponding first outer surface 123*a* and/or second outer surface 123*b* may be caused by a portion of an ionic current flowing from an adjacent repelling electrode 128. When this ionic current Ii flows through the porous material (e.g., the collecting portion 124) that has a relatively high electrical resistance $R_{por}$ (e.g., between 20 Megaohms and 2 Gigaohms) it creates certain potential difference $V_{dif}$ described by Ohm's law: $V_{dif}=Ii\times R_{por}$. This potential difference creates the electric field E in the body of the porous material. A charged particle (e.g., particulate matter) in this electric field E is subject to the Coulombic force F of the field E described by:

$F=q*E$, where $q$ is the particle electrical charge.

Under this force F, a charged particle may penetrate deep into the porous material (e.g., the collecting portion 124) where it remains. Accordingly, charged particulate matter may not only be directed and/or repelled toward the internal conductive portion 125 of the collecting electrodes 122, but may also be received, collected, and/or absorbed into the first collecting portion 124 of the individual collecting electrodes 122. As a result, particulate matter does not merely accumulate and/or adhere to the outer surfaces 123*a* and 123*b*, but is instead received and collected into the first collecting portion 124.

In some embodiments, for example, the porous material resistivity has a specific resistivity that allows the ionic current flow to the internal conductive portion 125 (i.e., should be slightly electrically conductive). In these embodiments, for example, the porous material can have a resistance on the order of Megaohms to prevent spark discharge between the collecting and the repelling electrodes.

In other embodiments, the strength of the electric field E can be adjustable in response to the relative size of the cells in the porous material (e.g., the collection portion 124). As those of ordinary skill in the art will appreciate, the electric field E needed to absorb particles into the collection portion 124 may be proportional to the cell size. For example, the strength of the electric field E can have a first value when the cells of the collection portion 124 have a first size (e.g., a diameter of approximately 150 microns). The strength of the electric field E can have a second value (e.g., a value greater than the first value) when the cells of the collecting portion 124 have a second size (e.g., a diameter of approximately 400 microns) to retain larger size particles accumulated therein.

As discussed above, the internal conductive portion 125 of the collecting electrodes 122 can be configured operate at an electrical potential different from either the first outer surface 123*a* or the second outer surface 123*b* of the individual collecting electrodes 122. Accordingly, charged particulate matter may not only be directed and/or repelled toward the internal conductive portion 125 of the collecting electrodes 122, but may also be received, collected, and/or absorbed into the first collecting portion 124 of the individual collecting electrodes 122. As a result, particulate matter does not merely accumulate and/or adhere to the outer surfaces 123*a* and 123*b*, but is instead received and collected into the first collecting portion 124. As explained above, the use of an open cell porous material in the first collecting portion 124 can provide a significant increase (e.g., 1000 times greater) in a collection surface area of the individual collecting electrodes 122 compared to embodiments without an open-cell porous media (e.g., collecting electrodes comprising metal plates). Moreover, because the collecting electrodes 122 are arranged generally parallel to the gas flow entering the housing 102, particulate matter in the gas can be removed with minimal pressure drop across the air cleaner 100 compared to conventional filters having fibrous media through which airflow is directed (e.g., HEPA filters).

After a period of use of the air cleaner 100, particulate matter can saturate the first collecting portion 124 of the individual collection electrodes. In some embodiments, the collecting electrodes 122 can be configured to be removable (and/or disposable) and replaced with different collecting electrodes 122. In other embodiments, the collecting electrodes 122 can be configured such that the used or saturated first collecting portion 124 can be removed from the internal conductive portion 125 and discarded, to be replaced by a new clean collecting portion 124, thereby refurbishing the collecting electrodes 122 for continued used without discarding the internal conductive portion 125. One feature of the present technology is that replacing or refurbishing the collecting electrodes 122 is expected to be more cost effective than replacing electrodes made entirely or substantially of metal. Moreover, the replaceability and disposability of the collecting electrodes 122, or the first collecting portion 124 thereof, facilitates removal of collected pathogens and contaminants from the system itself, and is expected to minimize the need for frequent cleaning. Furthermore, the present technology allows the filtering and/or cleaning of small particles in commercial HVAC systems without the need for adding a conductive fluid to the collecting electrodes 122.

Figure 2A:
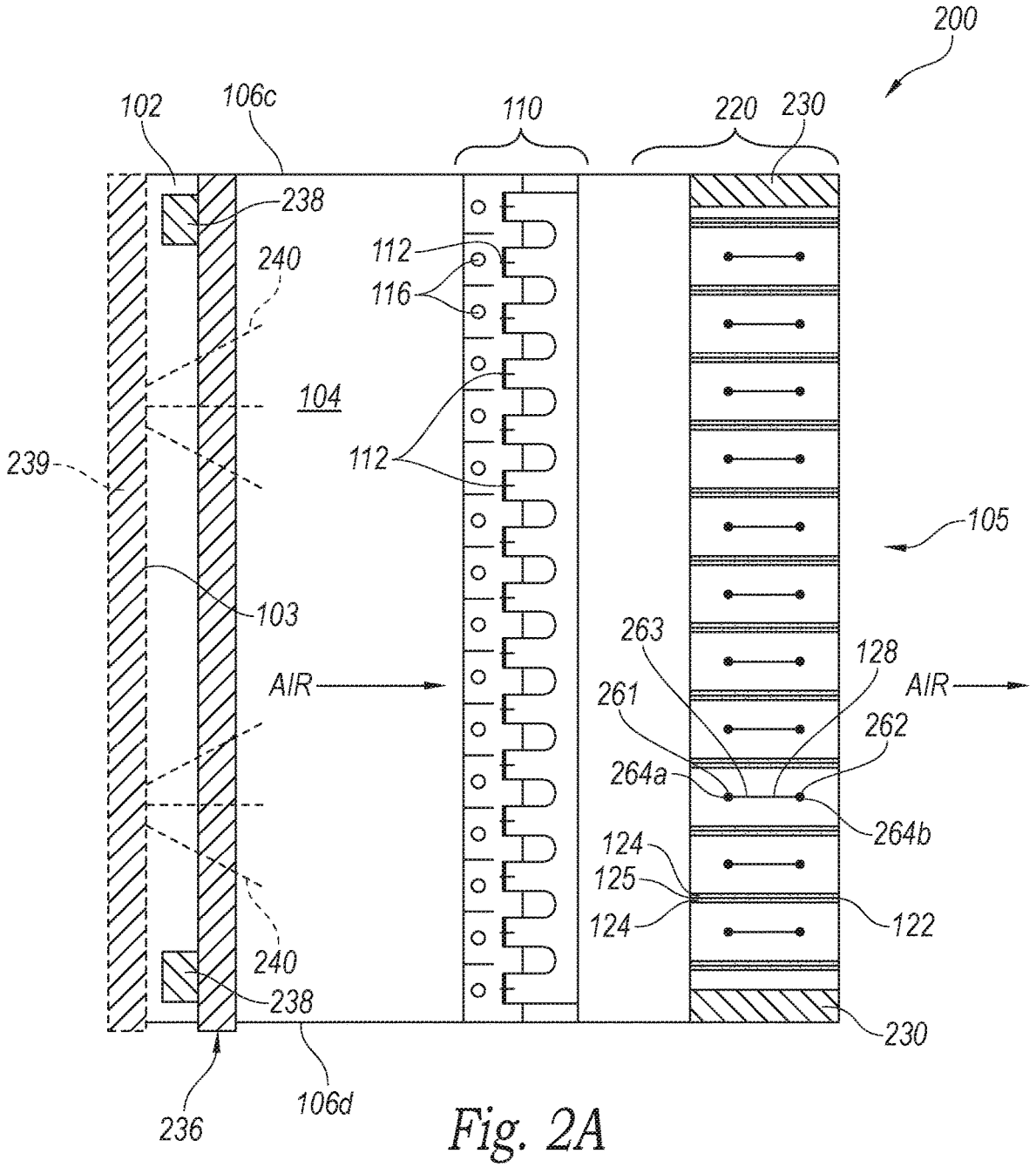
FIG. 2A is a schematic top view of an EAC configured in accordance with embodiments of the present technology.
Figure 2B:
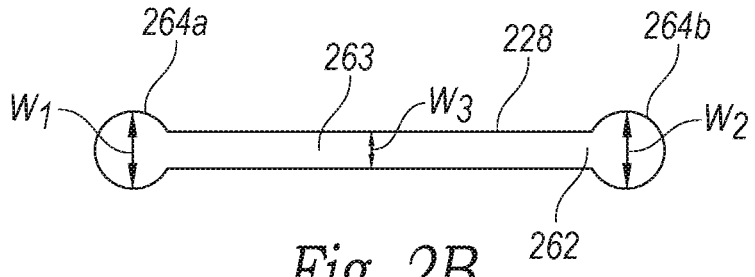
FIGS. 2B and 2C are schematic top views of repelling electrodes configured in accordance with an embodiment of the present technology.
Figure 2C:
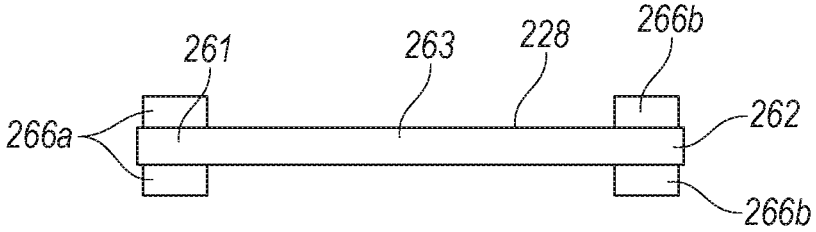

FIG. 2A is a schematic top view of an electronic air cleaner 200. FIGS. 2B and 2C are top views of a repelling electrode 228 configured in accordance with one or more embodiments of the present technology. Referring to FIGS. 2A-2C together, for example, the air cleaner 200 comprises a collecting stage 220 and a plurality of flashing portions 230. The individual flashing portions 230 can be disposed on either side of the collecting stage 220 to prevent air and/or particulate matter from passing through the collecting stage 220 without flowing adjacent one of the collecting electrodes 122. The collecting stage 220 further includes a plurality of repelling electrodes 228. The repelling electrodes 228 each have a proximal portion 261, a distal portion 262 and an intermediate portion 263 therebetween. A first projection 264*a*, disposed on the proximal portion 261, and a second projection 264*b*, disposed on the distal portion 262, can be configured, for example, to electrically repel charged particles (e.g., particulate matter in a gas flow), toward adjacent collecting electrodes 122. Moreover, the first and second projections 264*a* and 264*b* may also be configured to aerodynamically guide or otherwise direct particulate matter in the gas flow toward an adjacent collecting electrode 122.

As shown in FIG. 2B, the first projection 264*a* can have a first width $W_1$ and the second projection 264*b* can have a second width $W_2$. In the illustrated embodiment of FIG. 2B, the first width $W_1$ and the second width $W_2$ are generally the same. In other embodiments, however, the first width $W_1$ may be different from (e.g., less than) the second width $W_2$. Moreover, in the embodiment illustrated in FIG. 2B, the first and second projections 264*a* and 264*b* have a generally round shape. As shown in FIG. 2C, however, a first projection 266*a* and a second projection 266*b* can have a generally rectangular shape instead. Further, in other embodiments, the projections may have any suitable shape (e.g., triangular, trapezoidal, etc.).

Referring again to FIG. 2A, the air filter 200 further includes a ground stage 236 disposed within the housing 102 between the ionizing stage 110 and the inlet 103. The ground stage 236 can be configured operate at a ground potential relative to the ionizing stage 110. The ground stage 236 can also serve as a physical barrier to prevent objects (e.g., an operator's hand or fingers) from entering the air filter, thereby preventing injury and/or electric shock to the inserted objects. The ground stage 236 can include, for example, a metal grid, a mesh, a sheet having a plurality of apertures, etc. In some embodiments, for example, the ground stage 236 can include openings, holes, and/or apertures approximately ½" inch to ⅛" (e.g., ¼" inch) to prevent fingers from entering the cavity 104. In other embodiments, however, the ground stage 236 can include openings of any suitable size.

In certain embodiments, one or more occupation or proximity sensors 238 connected to an electrical power source (not shown) may be disposed proximate the inlet 103 as an additional safety feature. Upon detection of an object (e.g., an operator's hand), the proximity sensors 238 can be configured to, for example, automatically disconnect electrical power to the ionizing stage 110 and/or the collecting stage 120. In some embodiments, the proximity sensor 238 can also be configured to alert a facility control system (not shown) upon detection of an inserted object.

In certain embodiments, a fluid distributor, nebulizer or spray component 239 may be disposed at least proximate the inlet 103. The spray component 239 can configured to deliver an aerosol or liquid 240 (e.g., water) into the gas flow entering the air filter 200. The liquid 240 can enter the cavity 104 and be distributed toward the collecting stage 220. At the collecting stage 220, the liquid 240 can be absorbed by the first collecting portion 124. As those of ordinary skill in the art will appreciate, the liquid 240 (e.g., water) can regulate and modify the first electrical resistivity of the first collecting portion 124. In some embodiments, for example, a control system and/or an operator (not shown) can monitor an electric current between the collecting electrodes 122 and the repelling electrodes 228. If, for example, the electric current falls below a predetermined threshold (e.g., 1 microampere), the spray component 239 can be manually or automatically activated to deliver the liquid 240 toward the collecting stage 220. In other embodiments, for example, the spray component 239 can be activated to increase the effectiveness of one or more materials in the first collecting portion 124. Titanium dioxide, for example, can be more effective in killing pathogens (e.g., bacteria) when wet.

Figure 3:
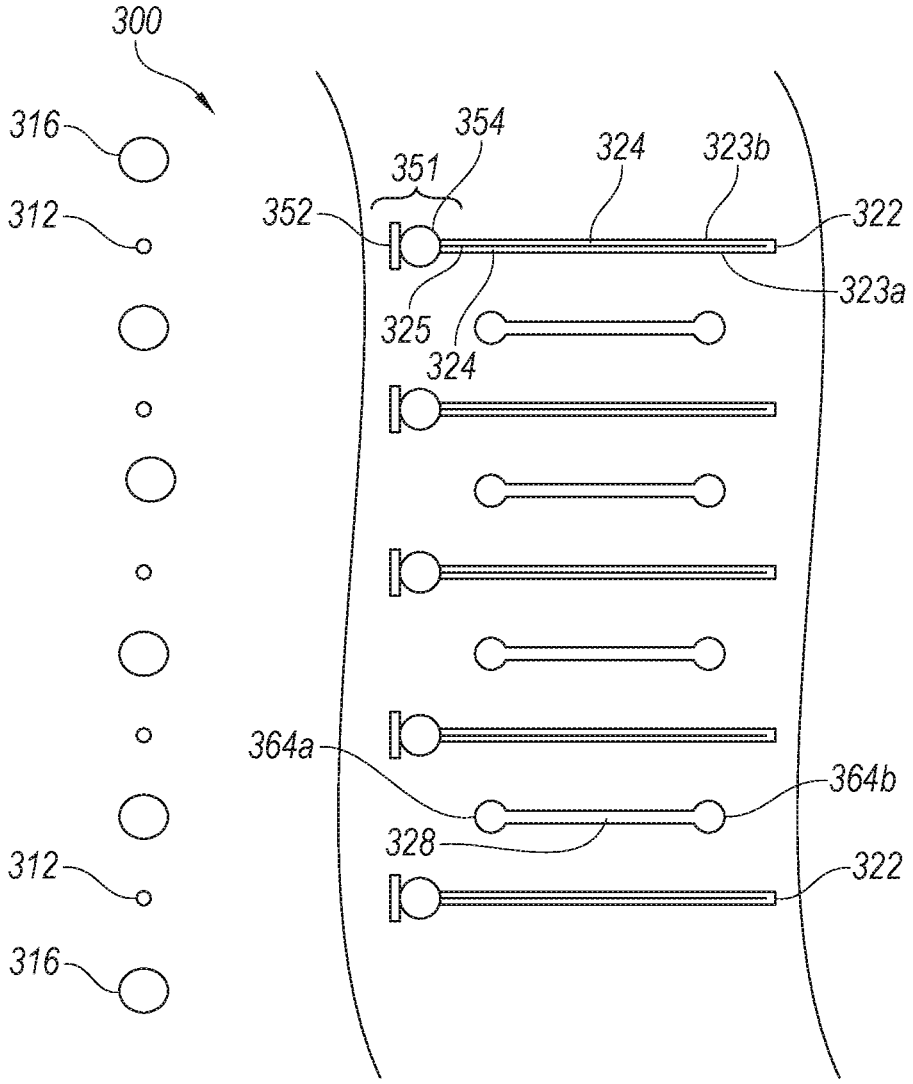
FIG. 3 is a schematic top view of a portion of an air filter configured in accordance with an embodiment of the present technology.

FIG. 3 is a schematic top view of an air filter 300 configured in accordance with an embodiment of the present technology. In the embodiment of FIG. 3, the air filter 300 includes an ionizing stage 310 having a plurality of corona electrodes 312 (e.g., analogous to the corona electrodes 112 of FIG. 1A). The air filter 300 further includes a collection stage includes the repelling electrodes 228 (FIGS. 2A-2C) and a plurality of collecting electrodes 322. A proximal portion 351 of the individual collecting electrodes 322 includes a first conductive portion 325 between a first outer surface 323*a* and an opposing second outer surface 323*b*. The first and second outer surfaces 323*a* and 323*b* can be positioned in the collecting stage 320 generally parallel to an airflow direction through the air filter 300. At least a portion of the first and second outer surfaces 323*a* and 323*b* can include a first collecting portion 324 (e.g., analogous to the first collecting portion 124 of FIG. 1A) comprising, for example, a first open-cell, porous material (e.g., a melamine foam or other suitable material).

A proximal portion 351 of the individual collecting electrodes 322 includes a second collecting portion 352 and a second conductive portion 354. In some embodiments, for example, the second collecting portion 352 can include, for example, a second material (e.g., a melamine foam, etc.) having a high resistivity (e.g., greater than $1\times10^9$ Ω-m) and can prevent sparking or another discharge from the corona electrodes 312 during operation. In other embodiments, however, the second collecting portion 352 can be configured as, for example, an exciting electrode and/or a collecting electrode. The second conductive portion 354 can further attract charged particles to the collecting electrode 322. The second conductive portion 354 (e.g., a tube or any other suitable shape) can include a second conductive material (e.g., metal, carbon powder, and/or any other suitable conductor) having second electrical resistivity different from a first electrical resistivity of the first material of the first collecting portion 324. While the first collecting portion 324 and the second conductive portion 354 may have different electrical resistivities, in other embodiments they may have generally the same electrical potential. In some embodiments, having materials of different electrical resistivities at the same electrical potential is expected to lower a spark over between the corona electrodes 312 and the collecting electrodes 322.

Figure 4A:
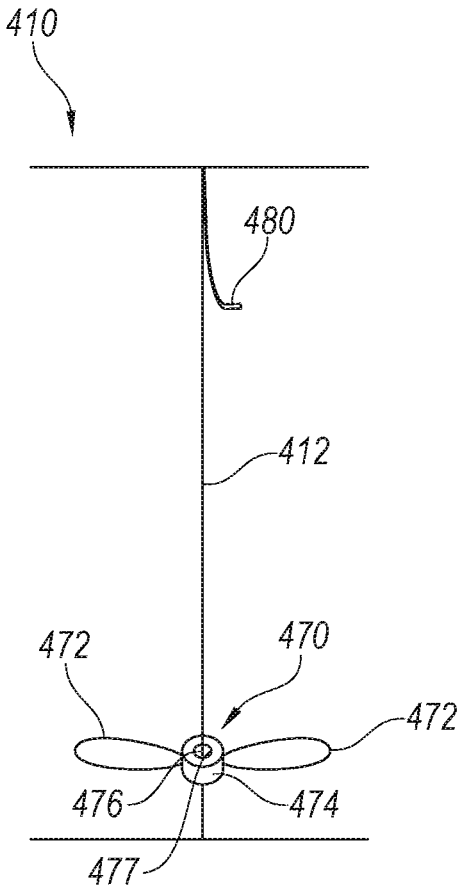
FIGS. 4A and 4B are side views of an ionization stage shown in a first configuration and a second configuration, respectively, in accordance with an embodiment of the present technology.
Figure 4B:
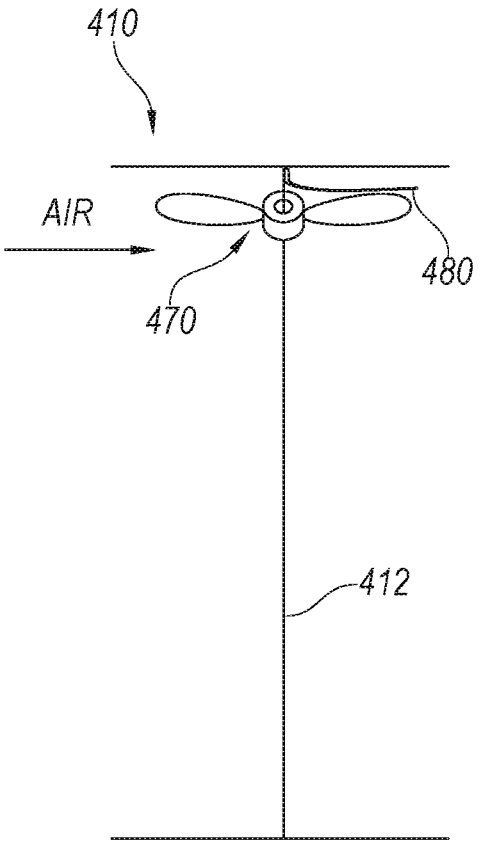

FIGS. 4A and 4B are side views of an ionization stage 410 shown in a first configuration and a second configuration, respectively, in accordance with an embodiment of the present technology. Referring to FIGS. 4A and 4B together, the ionization stage 410 includes a plurality of electrodes 412 (e.g., the corona electrodes 112 of FIG. 1A). Each of the electrodes 412 includes a cleaning device 470 configured to clean and/or remove accumulated matter (e.g., oxidation byproducts, silicon dioxide, etc.) along an outer surface of the electrodes 412. In the illustrated embodiment, the cleaning device 470 includes a plurality of propeller blades 472 circumferentially arranged around a center portion 474 having a bore 476 therethrough. The bore 476 includes an interior surface 477 configured to clean or otherwise engage the corresponding electrode 412.

The ionization stage 410 can be configured to be positioned in an airflow path (e.g. in the housing 102 of the air cleaner 100 of FIG. 1A). When air moves through the ionization stage 410, the airflow can propel the blades 472 and lift the cleaning device 470 upward along the electrode 412. As the cleaning device 470 slidably ascends along the electrode 412, the interior surface 477 engages the electrode 412, thereby removing at least a portion of the accumulated matter. When the cleaning device 470 reaches an upper extent of the electrode 412, a moveable stopper 480 can engage the cleaning device 470, thereby hindering further ascension of the electrode 412 (FIG. 4B). When the airflow substantially stops, for example, the cleaning device 470 may return to the position shown in FIG. 4A, thereby allowing the cleaning device 470 to continue cleaning the electrode 412.

In some embodiments, for example, the stopper 480 may have a shape of a leaf (or any other suitable shape, such as a square, rectangle, etc.) that is initially in a first configuration (e.g., a vertical configuration as shown, for example, in FIG. 4A). In response to the force of an airflow, the stopper 480 may move from the first configuration to a second configuration (e.g., a substantially horizontal configuration as shown, for example, in FIG. 4B). When the cleaning device 470 reaches the upper extent of the electrode 412, its rotation is hindered by the stopper 480 (FIG. 4B). The stopper 480 may remain in the second configuration as long as the airflow maintains an adequate pushing or lift force thereon. When the airflow ceases, however, the stopper 480 returns to the first configuration thereby releasing the cleaning device 470 and allowing the cleaning device 470 to return to the initial position shown in FIG. 4A, remaining there until receiving sufficient airflow for another cleaning cycle.

The disclosure may be defined by one or more of the following clauses:

1. An air filter, comprising:
   a housing having an inlet, an outlet, and a cavity therebetween; and
   an electrode assembly between the inlet and the outlet, wherein the electrode assembly includes a plurality of first electrodes and a plurality of second electrodes, wherein the first electrodes include an internal first conductive portion and an outer surface generally parallel with an airflow through the cavity, and wherein the first electrodes further include a first collecting portion comprising a first porous material.

2. The air filter of clause 1 wherein the first porous material has an open-cell structure.

3. The air filter of clause 1 wherein the first electrodes and second electrodes are arranged in alternating columns within the electrode assembly, and wherein the first electrodes have a first electrical potential and the second electrodes have a second electrical potential different from the first electrical potential.

4. The air filter of clause 1, further comprising a first corona electrode disposed in the cavity at least proximate the inlet.

5. The air filter of clause 5 wherein the individual first electrodes include a proximal end region at least adjacent the first corona electrode, and wherein at least some of the first electrodes include a second conductive portion between the first collecting portion and a second collecting portion disposed on the proximal end portion.

6. The air filter of clause 5 wherein the second conductive portion comprises a second material having a second electrical resistivity lower than a first electrical resistivity of the first material.

7. The air filter of clause 6 wherein the second collecting portion has a third electrical resistivity greater than the second electrical resistivity and different than the first electrical resistivity.

8. The air filter of clause 1 wherein the first material comprises melamine foam.

9. The air filter of clause 1 wherein the first collecting portion further comprises at least one of a disinfecting material and a pollution-reducing material.

10. The air filter of clause 1 wherein the second electrodes include a first end portion, a second end portion, and an intermediate portion therebetween, and wherein at least one of the first end portion and the second end portion include a projection having a first width greater than a second width of the intermediate portion.

11. The air filter of clause 4 wherein the first corona electrode comprises a wire, and wherein the air filter further comprises a cleaning device configured to slidably move from a first position on the wire to a second position on the wire.

12. The air filter of clause 11 wherein the cleaning device comprises a propeller having a center bore configured to receive the wire therethrough, wherein the bore includes an interior surface configured to engage the first corona electrode.

13. The air filter of clause 12 wherein the cleaning device comprises a stopper disposed proximate the second position, wherein the stopper is configured to alternate between a first configuration and a second configuration in response to the airflow, and wherein the stopper in the second configuration causes the cleaning device to return to the first position in the absence of the airflow.

14. A method of filtering air, the method comprising:
   creating an electric field using an ionizer arranged in an airflow path, wherein the ionizer is positioned to ionize at least a portion of air molecules from the airflow;
   applying a first electrical potential at a plurality of first electrodes spaced apart from the ionizer, wherein the individual first electrodes include—
      a first conductive portion configured to operate at the first electrical potential;
      a first collection portion removably coupled to the first conductive portion and comprising a porous media; and
      a first surface substantially parallel to a principal direction of the airflow path, wherein the first surface has an electrical potential different from the first electrical potential; and
   receiving, at the first collection portion, particulate matter electrically coupled to the ionized gas molecules.

15. The method of clause 14 wherein the porous media is made of a material capable of being electrically conductive in the absence of water.

16. The method of clause 14 wherein the porous media includes a porous material having an open-cell structure.

17. The method of clause 14, further comprising applying a second electrical potential at a plurality of second electrodes parallel to and spaced apart from the first electrodes, wherein the second electrical potential is different from the first electric potential such that the second electrodes repel the particulate matter to adjacent first electrodes.

18. The method of clause 14, further comprising automatically cleaning the corona electrodes, wherein at least one of the corona electrodes includes a cleaning device configured to slidably move along the corona electrode in response to the airflow, wherein the cleaning device comprises a propeller having a center bore configured to receive one of the corona electrodes therethrough, and wherein the bore includes an interior surface configured to engage the corona electrode.

19. An electrostatic precipitator, comprising:
   a housing having an inlet, an outlet, and a cavity;
   an ionizing stage in the cavity at least proximate the inlet, wherein the ionizing stage is configured to ionize gas molecules in air entering the cavity via the inlet; and
   a collecting stage in the cavity between the ionizing stage and the outlet, wherein the collecting stage includes a plurality of collecting electrodes having an outer surface generally parallel with an airflow through the cavity and a first collecting portion comprising a first porous media having an open-cell structure, and wherein the collecting electrodes are configured to receive and collect particulate matter electrically coupled to the ionized gas molecules.

20. The method of clause 19 wherein the porous media is made of an electrically conductive material.

21. The method of clause 19 wherein the porous media includes a porous material having an open-cell structure.

22. The electrostatic precipitator of clause 19, further comprising a plurality of repelling electrodes in the collecting stage, wherein the repelling electrodes are configured to repel the particulate matter to adjacent collecting electrodes.

23. The electrostatic precipitator of clause 19 wherein the collecting electrodes further comprise a second collecting portion made of a second material.

24. The electrostatic precipitator of clause 23 wherein the first porous media comprises melamine foam and the second material comprises activated carbon.

25. The electrostatic precipitator of clause 19 wherein the outer surface of the collecting electrodes comprises a combination of the first material and a material configured to destroy volatile organic compounds.

26. The electrostatic precipitator of clause 19 wherein the outer surface of the collecting electrodes comprises a combination of the first material and a disinfecting material.

27. The electrostatic precipitator of clause 19, further comprising an electrically grounded, air penetrable stage between the inlet and the ionization stage.

28. The electrostatic precipitator of clause 19, further comprising a first proximity sensor disposed between the inlet and the ionization stage, wherein the proximity sensor is configured to disconnect electric power to the ionization stage upon detection of an object at least proximate the inlet.

29. The electrostatic precipitator of clause 19 wherein the collecting electrodes comprise an internal conductive portion, and wherein the internal conductive portion has a first electrical potential different from a second electrical potential at the outer surface of the collecting electrodes.

The above detailed descriptions of embodiments of the technology are not intended to be exhaustive or to limit the technology to the precise form disclosed above. Although specific embodiments of, and examples for, the technology are described above for illustrative purposes, various equivalent modifications are possible within the scope of the technology, as those skilled in the relevant art will recognize. For example, while steps are presented in a given order, alternative embodiments may perform steps in a different order. The various embodiments described herein may also be combined to provide further embodiments.

Moreover, unless the word "or" is expressly limited to mean only a single item exclusive from the other items in reference to a list of two or more items, then the use of "or" in such a list is to be interpreted as including (a) any single item in the list, (b) all of the items in the list, or (c) any combination of the items in the list. Where the context permits, singular or plural terms may also include the plural or singular term, respectively. Additionally, the term "comprising" is used throughout to mean including at least the recited feature(s) such that any greater number of the same feature and/or additional types of other features are not precluded. It will also be appreciated that specific embodiments have been described herein for purposes of illustration, but that various modifications may be made without deviating from the technology. Further, while advantages associated with certain embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein.

I claim:

1. An electrostatic precipitator electrode, comprising:

a generally planar conductor; and a first generally planar collector disposed on a first side of said generally planar conductor in a parallel orientation to said generally planar conductor, wherein said first generally planar collector exhibits an open cell structure having a high electrical resistivity.

2. An electrostatic precipitator electrode according to claim 1 wherein said first generally planar collector is adhered to said generally planar conductor.

3. An electrostatic precipitator electrode according to claim 2, further comprising a second generally planar collector exhibiting a high resistivity open cell foam material disposed on a second side of said generally planar conductor opposite to said first side.

4. An electrostatic precipitator electrode according to claim 3 wherein said second generally planar collector is adhered to said generally planar conductor.

5. An electrostatic precipitator electrode according to claim 4 wherein said generally planar conductor further comprise a conductive film.

6. An electrostatic precipitator electrode according to claim 4 wherein said generally planar conductor further comprise a conductive ink.

7. An electrostatic precipitator electrode according to claim 4 wherein said second generally planar collector further comprises at least one of a metal grid and a conductive epoxy, and wherein said first and second generally planar collectors comprise a plurality of conductive particles distributed throughout the said first and second generally planar collectors.

8. An electrode assembly for an electrostatic precipitator, comprising:

two or more generally planar collector electrodes oriented in parallel and spaced apart, wherein said two or more generally planar collector electrodes comprise:

a first generally planar conductor; and at least a first generally planar collector disposed on a first side of said first generally planar conductor in a parallel orientation to said first generally planar conductor, wherein said first generally planar collector exhibits an open cell structure having a high electrical resistivity.

9. An electrode assembly for an electrostatic precipitator according to claim 8, further comprising a frame attached to said two or more generally planar collector electrodes.

10. An electrode assembly for an electrostatic precipitator according to claim 9, wherein said first generally planar conductors of said generally planar electrodes are electrically connected to a conductive portion of said frame.

11. An electrode assembly for an electrostatic precipitator according to claim 10, wherein said generally planar collector electrodes further comprise a second generally planar collector exhibiting a high resistivity open cell foam material disposed on a second side of said generally planar conductor opposite to said first side.

12. An electrode assembly for an electrostatic precipitator according to claim 11 further comprising a plurality of repelling electrodes arranged in parallel to and alternating with said generally planar collector electrodes.

13. An electrode assembly for an electrostatic precipitator according to claim 12 wherein said two or more generally planar collector electrodes further comprise a second conductor portion having a different electrical resistivity than said first generally planar conductor and electrically connected to said first generally planar conductor.

14. An electrode assembly for an electrostatic precipitator according to claim 13 wherein an electrical resistivity of said second conductor portion is lower than an electrical resistivity of said first generally planar conductor.

15. An electrode assembly for an electrostatic precipitator according to claim 14 wherein said first generally planar collector comprises melamine foam.

16. An electrode assembly for an electrostatic precipitator according to claim 15 wherein one or more of said generally planar collecting electrodes further comprises a disinfecting material.

17. An electrode assembly for an electrostatic precipitator according to claim 16 wherein said plurality of repelling electrodes are generally planar and include an edge which is wider than a width of an intermediate portion of said plurality of repelling electrodes.

18. An electrode assembly for an electrostatic precipitator according to claim 11 wherein said generally planar conductors further comprise a conductive film.

19. An electrode assembly for an electrostatic precipitator according to claim 11 wherein said generally planar conductors further comprise a conductive ink.

20. An electrode assembly for an electrostatic precipitator according to claim 11 wherein said first and second generally planar conductors further comprise at least one of a metal grid, a conductive epoxy, and a plurality of conductive particles distributed throughout said first and second generally planar conductors.

* * * * *